US008434499B2

(12) United States Patent
Karles et al.

(10) Patent No.: US 8,434,499 B2
(45) Date of Patent: May 7, 2013

(54) FILTER DESIGN FOR IMPROVING SENSORY PROFILE OF CARBON FILTER-TIPPED SMOKING ARTICLES

(75) Inventors: Georgios Karles, Richmond, VA (US); Christopher Allmond, Mechanicsville, VA (US); Stephen Wayne Rose, New Kent, VA (US)

(73) Assignee: Philip Morris USA Inc., Richmond, VA (US)

( * ) Notice: Subject to any disclaimer, the term of this patent is extended or adjusted under 35 U.S.C. 154(b) by 13 days.

(21) Appl. No.: 13/008,599

(22) Filed: Jan. 18, 2011

(65) Prior Publication Data

US 2012/0000482 A1 Jan. 5, 2012

Related U.S. Application Data

(63) Continuation of application No. 12/801,286, filed on Jun. 1, 2010, now abandoned, which is a continuation of application No. 12/577,043, filed on Oct. 9, 2009, now abandoned.

(51) Int. Cl.
*A24D 3/04* (2006.01)

(52) U.S. Cl.
USPC ..... 131/336; 131/338; 131/339; 131/340

(58) Field of Classification Search ..... 131/338, 131/339, 340, 336
See application file for complete search history.

(56) References Cited

U.S. PATENT DOCUMENTS 2,592,553 A 4/1952 Frankenburg et al.
2,592,554 A 4/1952 Frankenburg
2,598,680 A 6/1952 Frankenburg
2,769,734 A 11/1956 Bandel
2,954,783 A 1/1960 Lebert
2,954,772 A 10/1960 Lebert
2,954,778 A 10/1960 Lebert
2,954,786 A 10/1960 Lebert
3,098,492 A 7/1963 Wurzburg et al.

(Continued)

FOREIGN PATENT DOCUMENTS

BE 679657 A 10/1966
BE 1000454 A4 12/1988

(Continued)

OTHER PUBLICATIONS

International Preliminary Report on Patentability issued Apr. 11, 2012 for PCT/EP2010/006194.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

A filter for a smoking article, which includes an upstream segment having a carbon filter and a downstream segment of filtering material. The upstream segment includes a carbon filter with a hollow tubular member concentrically positioned within the carbon filter, and one or more holes around an outer circumference of the hollow tubular member to allow mainstream smoke to bypass the carbon filter during the first puff. During use, the hollow tubular member has a lower resistance to draw than the carbon filter during an initial puff or puffs, and after the initial puff or puffs, mainstream smoke is drawn through the carbon filter.

20 Claims, 8 Drawing Sheets

U.S. PATENT DOCUMENTS 3,219,040 A 11/1965 Kim
3,236,244 A 2/1966 Irby, Jr. et al.
3,255,760 A 6/1966 Selke
3,283,762 A 11/1966 Kissel
3,318,312 A 5/1967 Curtis, Jr.
3,356,094 A 12/1967 Ellis et al.
3,395,713 A 8/1968 Ent-Keller
3,457,927 A 7/1969 Siragusa
3,496,945 A 2/1970 Tomkin
3,581,748 A 6/1971 Cameron
3,621,851 A * 11/1971 Heskett et al. ..... 131/339
3,637,447 A 1/1972 Berger et al.
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,091,821 A 5/1978 Scorzo
4,119,105 A 10/1978 Owens, Jr.
4,120,310 A 10/1978 Lee et al.
4,135,523 A 1/1979 Luke et al.
4,182,349 A 1/1980 Selke
4,186,756 A 2/1980 Takemoto et al.
4,197,863 A 4/1980 Clayton et al.
4,256,122 A 3/1981 Johnson
4,256,126 A 3/1981 Seligman et al.
4,273,141 A 6/1981 Jan Van Tilburg
4,292,983 A 10/1981 Mensik
4,340,072 A 7/1982 Bolt et al.
4,341,228 A 7/1982 Keritsis et al.
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A 9/1984 Browne et al.
4,508,525 A 4/1985 Berger
4,515,170 A 5/1985 Cantrell et al.
4,542,755 A 9/1985 Selke et al.
4,564,030 A 1/1986 Jessup et al.
4,574,820 A 3/1986 Pinkerton et al.
4,585,015 A 4/1986 Silberstein
4,622,982 A 11/1986 Gaisch et al.
4,637,409 A 1/1987 Berger
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,732,168 A 3/1988 Resce et al.
4,754,766 A 7/1988 Luke et al.
4,784,632 A 11/1988 Berger
4,793,365 A 12/1988 Sensabaugh et al.
4,867,182 A 9/1989 Roberts et al.
4,896,682 A 1/1990 Liew
4,924,886 A 5/1990 Litzinger
4,942,887 A 7/1990 Abdelgawad et al.
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A 10/1991 Henning et al.
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,439,011 A 8/1995 Schneider
5,458,107 A 10/1995 Balogh et al.
5,524,647 A 6/1996 Brackmann
5,533,530 A 7/1996 Young et al.
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A 3/1998 Meiring et al.
5,743,251 A 4/1998 Howell et al.
5,746,230 A 5/1998 Arterbery et al.
5,839,449 A 11/1998 Banerjee et al.
5,954,061 A 9/1999 Cardarelli
6,089,238 A 7/2000 Schneider et al.
6,216,706 B1 4/2001 Kumar et al.
6,257,242 B1 7/2001 Stavridis
6,718,989 B1 4/2004 Clarke et al.
6,761,174 B2 7/2004 Jupe et al.
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
2002/0166561 A1 11/2002 Sinclair
2003/0200973 A1 10/2003 Xue et al.
2004/0025890 A1 2/2004 Yen
2004/0159327 A1 8/2004 Dante
2004/0261807 A1 12/2004 Dube et al.
2005/0066981 A1 3/2005 Crooks et al.
2006/0201524 A1 9/2006 Zhang et al.
2007/0181140 A1 8/2007 Xue et al.
2007/0186945 A1 8/2007 Olegario et al.
2007/0235050 A1 10/2007 Li et al.
2007/0261706 A1 11/2007 Banerjea et al.
2008/0017204 A1 1/2008 Braunshteyn et al.
2008/0047571 A1 2/2008 Braunshteyn et al.
2008/0163877 A1 7/2008 Zhuang et al.
2008/0216848 A1 9/2008 Li et al.
2008/0216851 A1 9/2008 Olegario et al.
2011/0048436 A1 3/2011 Fiebelkorn

FOREIGN PATENT DOCUMENTS

DE 3439861 A1 5/1985
EP 0077123 A2 4/1983
EP 0212879 A1 3/1987
EP 0364256 A1 4/1990
EP 0471 581 A1 2/1992
EP 0482 872 A1 4/1992
EP 0568107 A 11/1993
EP 0481596 B1 1/1994
EP 0608047 A2 7/1994
FR 2481581 11/1981
GB 1058342 A 2/1967
GB 1228747 4/1971
GB 1256154 12/1971
GB 1397936 A 6/1975
GB 1436636 A 5/1976
GB 2100573 A 1/1983
GB 2149287 A 6/1985
GB 2177890 A 2/1987
WO WO 90/09741 A 9/1990
WO WO99/26495 A 6/1999
WO WO00/00047 1/2000
WO WO 02/03819 A 1/2002
WO WO 2006/070289 A 7/2006
WO WO2006/082529 A 8/2006
WO WO2007/093757 A1 8/2007
WO WO2007/110650 A1 10/2007
WO WO 2008/059377 A2 5/2008

OTHER PUBLICATIONS

International Search Report and Written Opinion dated Mar. 17, 2008 for PCT/IB2006/004209.
International Preliminary Report on Patentability mailed Sep. 24, 2009 for International Application No. PCT/IB2008/001372.
International Search Report and Written Opinion dated Nov. 3, 2008 for PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/001144 dated Jul. 7, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion issued Jan. 25, 2008 for PCT/IB2007/002869.
International Preliminary Report on Patentability issued Jan. 13, 2009 for PCT/IB2007/002910.
International Preliminary Report of Patentability issued Jul. 10, 2008 for PCT/IB2006/004209.
International Search Report and Written Opinion issued Sep. 19, 2008 for PCT/IB2007/004503.
International Preliminary Report on Patentability issued Jul. 9, 2009 for PCT/IB2007/004503.
International Preliminary Report on Patentability issued Jul. 10, 2008 for PCT/IB2006/004202.
Written Opinion dated Aug. 5, 2004 for International Application No. PCT/US04/04530.
International Search Report dated Aug. 5, 2004 for PCT/US04/04530.
Invitation to Pay Additional Fees and Annex to Form PCT/ISA/206 Communication Relating to the Results of the Partial International Search dated Oct. 16, 2007 for International Application No. PCT/IB2006/004209.
International Search Report and Written Opinion dated Oct. 19, 2007 for PCT/IB2006/004202.
International Search Report and Written Opinion mailed Feb. 10, 2011 for PCT/EP2010/006194.

* cited by examiner

FILTER DESIGN FOR IMPROVING SENSORY PROFILE OF CARBON FILTER-TIPPED SMOKING ARTICLES

CROSS REFERENCE TO RELATED APPLICATION

This application is a continuation application of U.S. application Ser. No. 12/801,286 entitled FILTER DESIGN FOR IMPROVING SENSORY PROFILE OF CARBON FILTER-TIPPED SMOKING ARTICLES, filed Jun. 1, 2010 now abandoned, which is a continuation application of U.S. application Ser. No. 12/577,043 entitled FILTER DESIGN FOR IMPROVING SENSORY PROFILE OF CARBON FILTER-TIPPED SMOKING ARTICLES, filed on Oct. 9, 2009 now abandoned, the entire content of each is hereby incorporated by reference.

WORKING ENVIRONMENT

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. The tobacco rod is generally about 7.0 and 10.0 millimeters in diameter and 60 millimeters and 125 millimeters in length.

Typically, the filter includes a plug of cellulose acetate tow attached to the tobacco rod by tipping paper. Ventilation of mainstream smoke can be achieved with a row or rows of perforations about a location along the filter. In addition, activated carbon can be added to the filter to remove many gas phase components from the smoke. Unfortunately, American smokers perceive a taste deficit with carbon-filter cigarettes.

DETAILED DESCRIPTION

It would be desirable for a smoking article that provides an acceptable flavor during the first puff or puffs and thereafter directs the mainstream smoke through a carbonaceous and/or highly ventilated filter. In addition, it would be desirable to have that filter deliver a flatter profile for volatile organic compounds (VOC) and subsequently a more balanced taste with an initial bypassing of the carbonaceous and/or highly ventilated filter portion of the filter.

In accordance with one embodiment, a filter for a smoking article comprises: an upstream segment comprising: a carbon filter; and a hollow tubular member concentrically positioned within the carbon filter and having one or more holes around an outer circumference of the hollow tubular member to allow mainstream smoke to bypass the carbon filter during the first puffs, and after the initial puff or puffs, mainstream smoke is drawn through the carbon filter; and a downstream segment of filtering material.

In accordance with another embodiment, a smoking article comprises: a tobacco rod of a smokable material; and a filter attached to the tobacco rod of smokable material, the filter comprising: an upstream segment of an activated carbon material, wherein the upstream segment includes a hollow tubular member concentrically positioned within the activated carbon material, and wherein the hollow tubular member has one or more holes around an outer circumference of the hollow tubular member to allow mainstream smoke to bypass the carbon filter during the first puffs; a downstream segment of filtering material; a cavity located between the upstream segment and the downstream segment; and wherein the hollow tubular member has a lower resistance to draw than the activated carbon material during an initial puff or puffs on the smoking article, and wherein after the initial puff or puffs the mainstream smoke is drawn through the activated carbon material.

Figure 1:
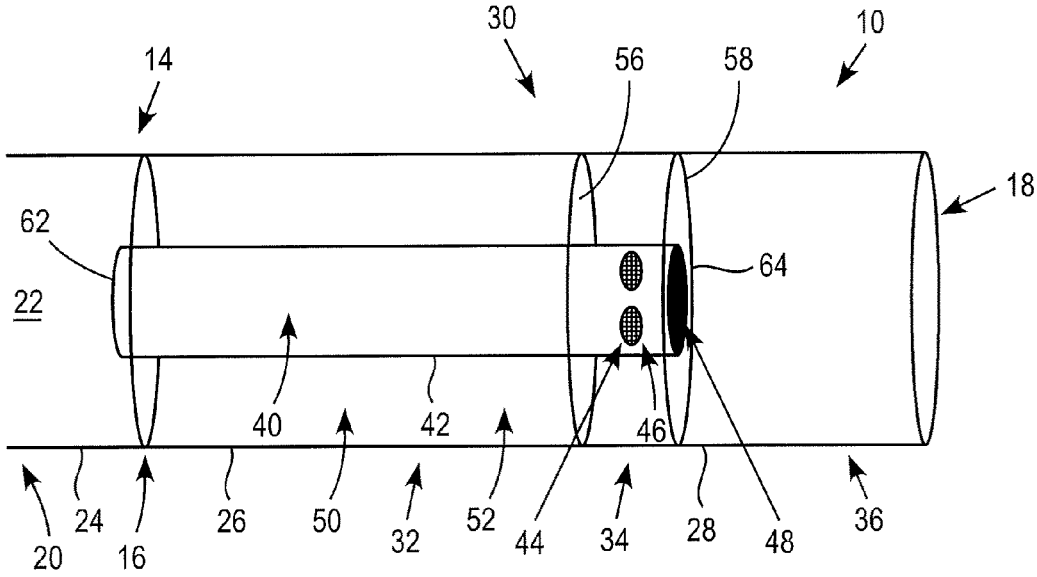
FIG. 1 is a perspective view of a smoking article in accordance with one embodiment.

FIG. 1 shows a perspective view of a smoking article 10 in the form of a cigarette comprised of a tobacco rod 20 and a filter 30 in accordance with one embodiment. The filter 30 is comprised of an upstream segment 32, a downstream segment 36, and an open cavity 34 located between the upstream and downstream segments 32, 36. In accordance with one embodiment, the upstream segment 32 is a carbon filter 50 having a channel 40 concentrically position therein. In accordance with one embodiment, the channel 40 is comprised of a hollow tubular member 42 (i.e., bypass tube) having one or more holes 44 around an outer circumference 46 of the tubular member 42. In use, the channel 40 preferably has a lower resistance to draw than the carbon filter 50, such that mainstream smoke from the initial puffs (i.e., first, second, third, etc.) bypasses the carbon filter 50. The channel 40 delivers mainstream smoke at the initiation of smoking that at least in substantial part, has not contacted any activated carbon and is therefore without the taste deficits commonly associated with a carbon-filter cigarette. Following the initial puffs on a smoking article 10, the holes 44 become clogged or blocked such that the smoke from the subsequent puffs will be drawn through a carbon filter 50 containing a carbonaceous material, or optionally other filter adsorbent or catalyst materials.

As shown in FIG. 1, smokable material 22 is contained in a circumscribing outer wrapper 24. The outer wrapper 24 is typically a porous wrapping material or paper wrapper. The rod 20 is typically referred to as a "tobacco rod" and has a lit end or upstream end (not shown) and a downstream or tipped end 14. The smokable material 22 is preferably a shredded tobacco or tobacco cut filler. However, any suitable smokable material 22 can be used.

The filter 30 is adjacent to the tipped end 14 of the tobacco rod 20 such that the filter 30 and tobacco rod 20 are axially aligned in an end-to-end relationship, preferably abutting one another. The filter 30 has a generally cylindrical shape, and the diameter thereof is essentially equal to the diameter of the tobacco rod 20. The ends (i.e., upstream end 16 and downstream end 18 (i.e., mouth end or buccal end) of the filter 30 are open to permit the passage of air and smoke therethrough.

In accordance with one embodiment, an upstream segment 32 comprised of the carbon filter 50 and a hollow tubular member 42, which is concentric to the carbon filter 50, a downstream (or mouth end) segment 36, and a cavity 34 located between the upstream and the downstream segments 32, 36. The carbon filter 50 is preferably comprised of an activated carbon material mixed with a cellulose acetate material or carbon on tow (COT) segment 52. Alternatively, the carbon filter 50 can be a crimped carbon paper, a carbon monolith or a cavity filled with granular or beaded carbon, or other suitable carbon material or composition.

A plug wrap 26 preferably circumscribes the entire length of the filter 30 including the upstream segment 32, the cavity 34 and the downstream segment 36. In accordance with one embodiment, the plug wrap 26 is a paper, which optionally may incorporate a carbonaceous material. The filter 30 is attached to the tobacco rod 20 by a tipping paper 28, which circumscribes both the entire length of the filter 30 and an adjacent region of the tobacco rod 20. The tipping paper 28 is typically a paper like product; however, any suitable material can be used.

Figure 3:
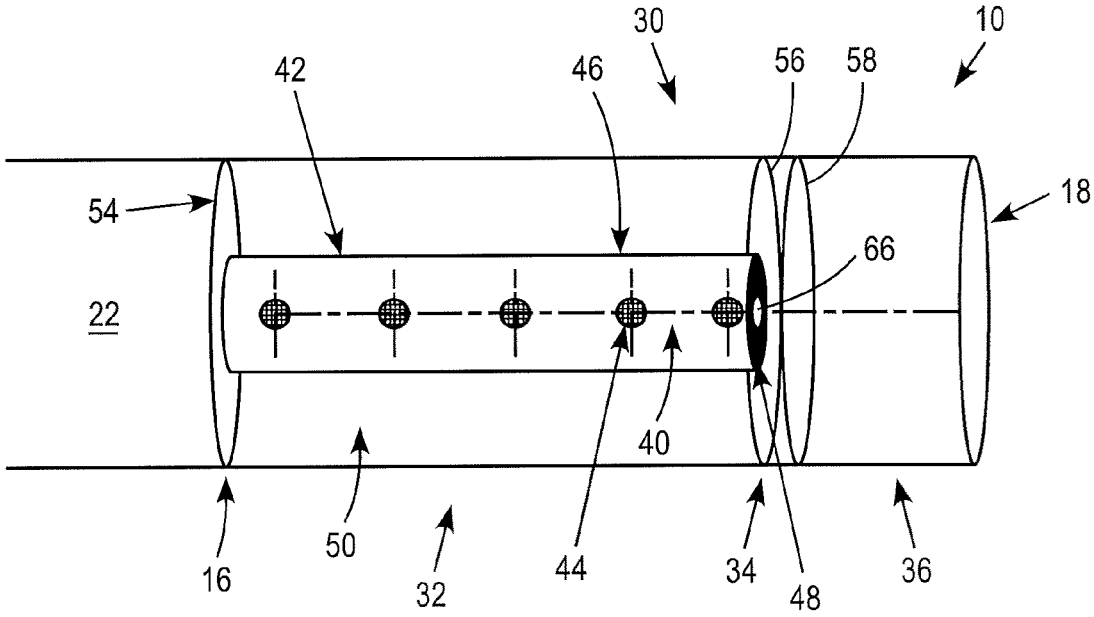
FIG. 3 is a perspective view of a smoking article in accordance with a further embodiment.

In accordance with one embodiment, as shown in FIG. 1, the channel 40 is preferably comprised of a hollow tubular member 42 having one or mores holes 44 in an outer circumference 46 in fluid communication with cavity 34, and an impermeable plug 48 on a downstream end 64 of the hollow tubular member 42. In accordance with one embodiment, the downstream end 64 of the hollow tubular member 42 preferably abuts against the downstream segment 36 of the filter 30. Alternatively, the downstream end 64 of the hollow tubular member 40 can be positioned within the cavity 34 or located at a downstream end 56 of the upstream segment 32 (FIG. 3). On the upstream end 62, the tubular member 42 optionally extends into the tobacco rod 20 or abuts the tipped end 14 of the tobacco rod 20.

The hollow tubular member 42 can be comprised of an impermeable material and/or a permeable material depending on desired permeability and/or resistance to draw (RTD) of the filter 30 in the axial and radial directions. In accordance with one embodiment, the hollow tubular member 42 can be a hollow paper tube or a hollow plastic tube. In another embodiment, the hollow tubular member 42 can be filled with a suitable material to controlled permeability and/or controlled resistance to draw (RTD) of the hollow tubular member 42.

In accordance with a preferred embodiment, the carbon filter 50 is a carbon on tow segment 52 having a length of approximately 22 mm surrounding a tubular member 42 having a length of approximately 25 mm in length. As a result of the differential length between the carbon filter 50 and the hollow tubular member 42, the hollow tubular member 42 extends into the cavity 34 located between the upstream segment 32 and the downstream segment 36.

The downstream end 64 of the hollow tubular member 42 preferably extends beyond a downstream end 56 of the carbon filter 50 of the filter 30 by approximately 1 to 5 mm and more preferably approximately 2 to 3 mm. As shown in FIG. 1, the holes 44 are located around an outer circumference 46 of the hollow tubular member 42 near the sealed end 48. The holes 44 preferably comprise at least one circumferential row of at least two openings or holes 44. In accordance with one embodiment, the at least one row of holes 44 is preferably positioned around the outer circumference 46 of the sealed end 48 and number between two (2) and six (6) depending on the size of the openings or holes 44. In accordance with an embodiment, the holes 44 preferably have a diameter of approximately 0.5 mm or less.

The downstream segment 36 (i.e., mouth end) of the filter 30 is preferably comprised of a filtering material such as a starch-based, polypropylene, or plasticized cellulose acetate tow. The filtering material of the downstream segment 36 can also have the form of a gathered web (e.g., polypropylene web, polyester web, cellulosic web or starch-based web).

During an initial puff or puffs, smoke is drawn through the concentric hollow tube or channel 40 due to its low resistance to draw. Thus, by the time of subsequent puffs on the smoking article 10, the holes 44 of the tubular member 42, which forms the channel 40, are partially or totally blocked, such that the mainstream smoke no longer passes preferentially through the tubular member 42 but instead is drawn through the length of the carbon filter 50.

In accordance with one embodiment, the channel 40 has a lower resistance to draw (RTD) than the carbon filter 50 allowing a portion of the mainstream smoke to pass through the hollow tubular member 42 without coming in contact with the carbonaceous material within the carbon filter 50. As particulate matter is drawn through the holes 44 at the sealed end 46 of the hollow tubular member 42, the holes 44 become clogged with the particulate matter and tar preventing further bypass and the entirety of the mainstream smoke is then filtered through the carbon filter 50:

It can be appreciated that the resistance to draw (RTD) and the flow distribution of the channel 40 and the carbon filter 50 can depend on several factors including the length of the filter 30, and the nature or type of filter materials within the carbon filter 50 and the downstream segment 36. Alternatively, the resistance to draw (RTD) and flow distribution of the filter can be changed and/or controlled based on the amount and the activity of carbonaceous material of the carbon filter 50.

Figure 2:
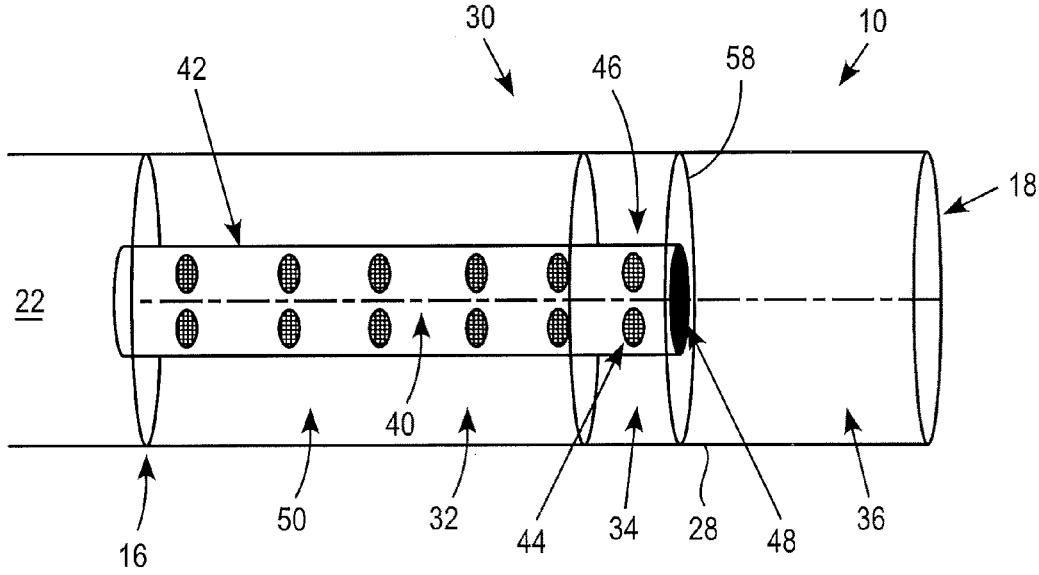
FIG. 2 is a perspective view of a smoking article in accordance with another embodiment.

As shown in FIG. 2, the filter 30 includes a channel 40, which is coaxially or concentrically positioned within the carbon filter 50. The channel 40 preferably extends from the upstream end 16 of the filter 30 to an upstream end 58 of the downstream segment 36 and abutting against the downstream segment 36 of the filter 30. The channel 40 is preferably comprised of a hollow tubular member 42 having a plurality or series of holes 44 in the outer circumference 46, and an impermeable plug 48 on the downstream end of the hollow tubular member 42. In accordance with one embodiment, the hollow tubular member 42 includes a series of holes 44 around the outer circumference 46 of the tubular member 42 and extending the length of the tubular member 42. The series of openings or holes 44 preferably comprise at least two circumferential rows of at least two openings or holes 44 along the length of the tubular member 42.

As shown in FIG. 3, the hollow tubular member 42 includes a series of one or more openings or holes 44 around the circumference of the tubular member 42 and extending the length of the tubular member 42. In accordance with one embodiment, the tubular member 42 extends from an upstream end 54 of the carbon filter 50 to the downstream end 56 of the carbon filter 50. The impermeable plug 48 at the downstream end of the tubular member 42 is preferably adjacent to, or optionally located within the cavity 34. The plurality of openings or holes 44, preferably comprises at least two circumferential rows of at least two openings or holes 44 along the length of the tubular member 42. In accordance with one embodiment, the impermeable plug 48 at the downstream end of the tubular member 42 includes a bypass opening or hole 66. Preferably, the bypass opening or hole 66 is centrally located within the impermeable plug 48 and has an outer diameter of approximately 0.5 mm or less. Preferably, the impermeable plug 48 is a hot melt glue plug or other suitable plug. In accordance with one embodiment, the bypass opening or hole 66 is preferably punched into the impermeable plug 48 and permits tar impaction at the downstream segment 36 (or cellulose acetate (CA) mouthpiece).

Figure 4A:
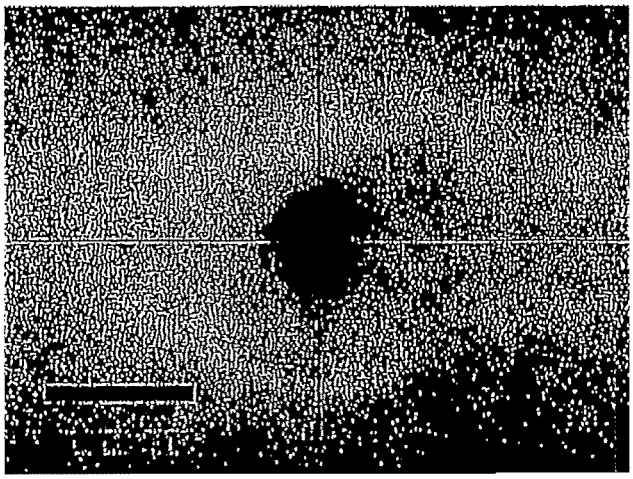
FIG. 4A is an image of unblocked hole of a smoking article as shown in FIGS. 1-3.
Figure 4B:
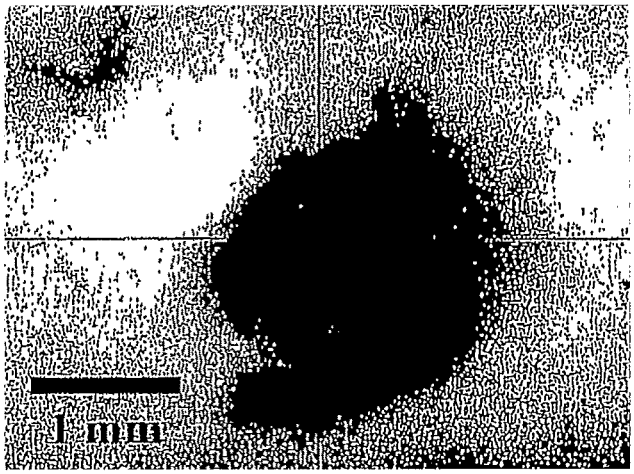
FIG. 4B is an image of a hole blocked by tar of the smoking article of FIG. 4A after the smoking article was smoked on a smoking machine under Federal Trade Commission (FTC) conditions (35 cc, 2 second duration, sine wave profile).

FIGS. 4A and 4B show images of unblocked hole of a smoking article, and a hole blocked by tar of the smoking article of FIG. 4A after the smoking article was smoked on a smoking machine under FTC conditions (35 cc, 2 second duration, sine wave profile). The results as shown in FIGS. 4A and 4B were obtained using a filter as shown in FIG. 2 having a carbon on tow segment (COT) of approximately 22 mm in length, and a bypass tube of approximately 25 mm in length.

Figure 8:
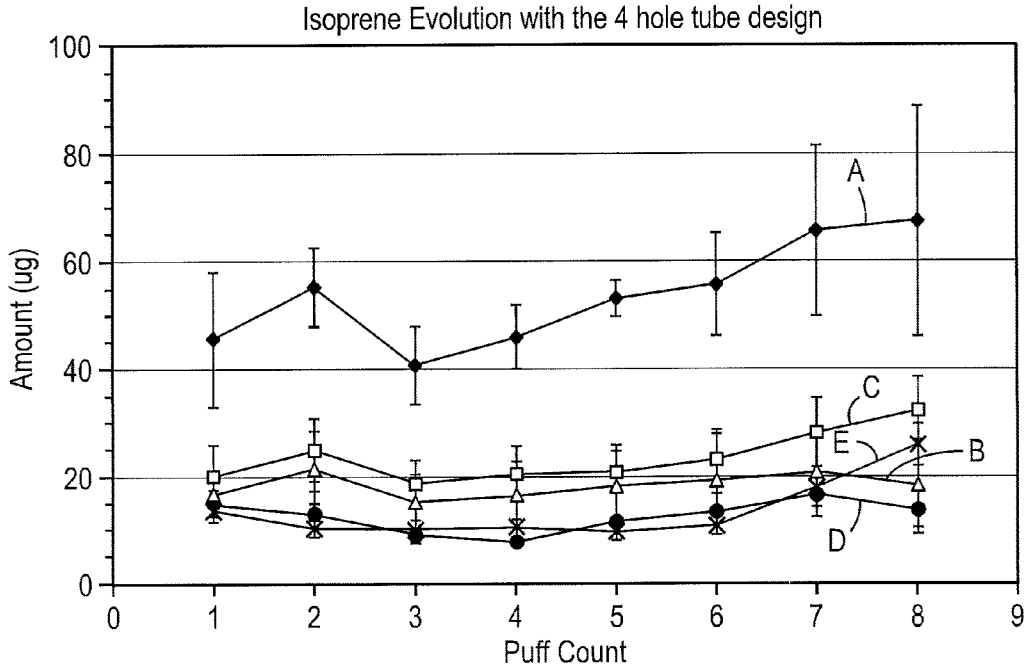
FIG. 8 is a graph of isoprene evolution versus puff count for a smoking article as shown in FIG. 1.
Figure 9:
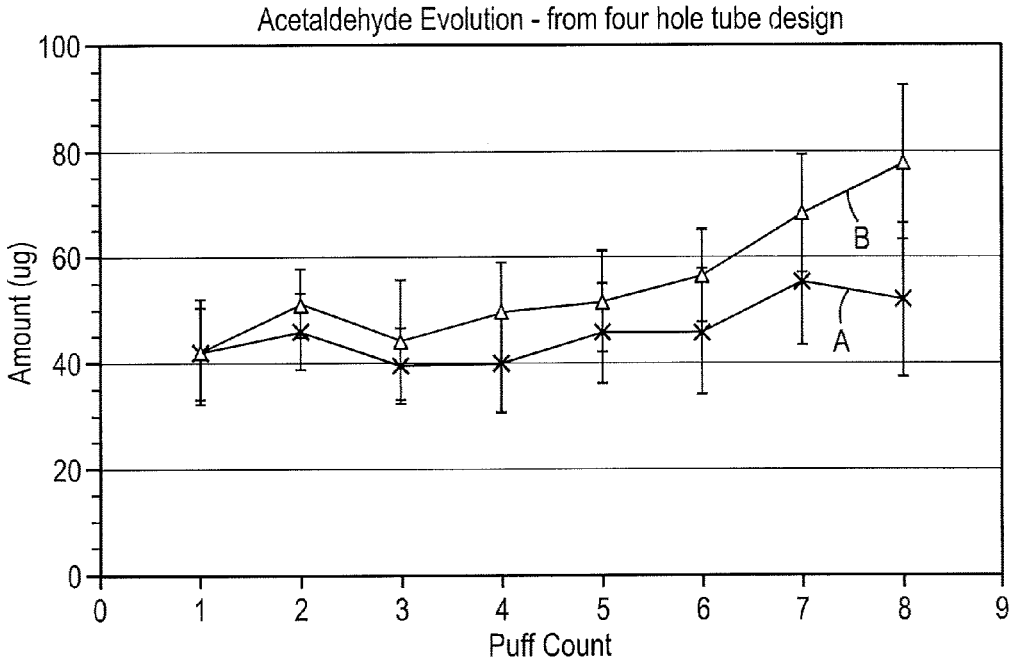
FIG. 9 is a graph of acetaldehyde evolution versus puff count for a smoking article in accordance with another embodiment.
Figure 10:
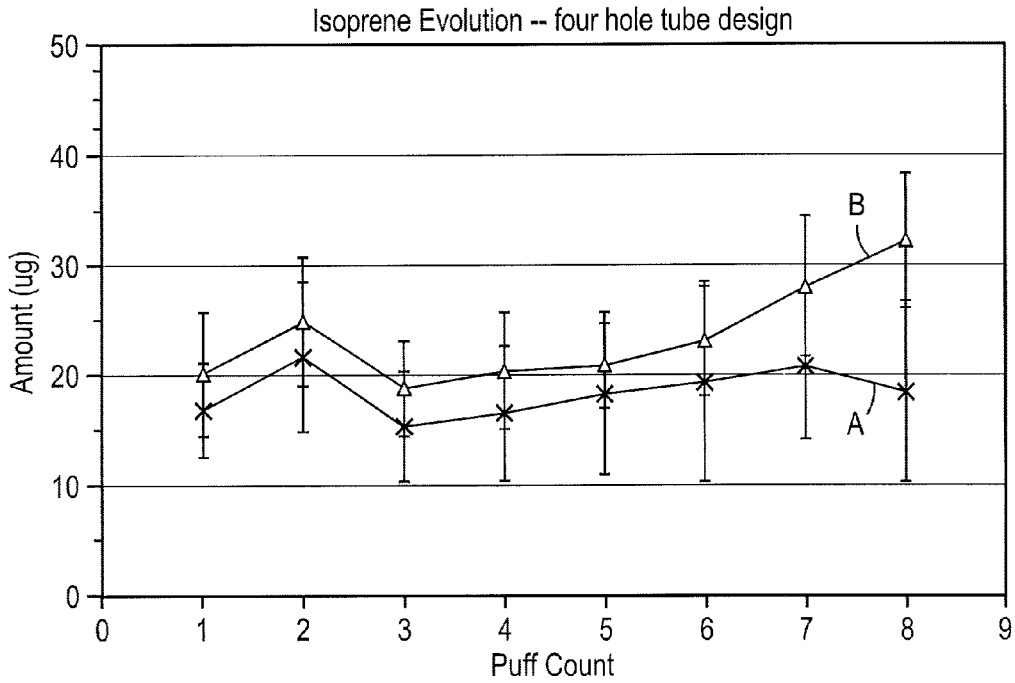
FIG. 10 is a graph of isoprene evolution versus puff count for a smoking article in accordance with a further embodiment.

FIGS. 5, 7, 9 and 12 are graphs showing acetaldehyde evolution versus puff count in accordance with various filter configurations. FIGS. 6, 8, 10 and 13 are graphs showing isoprene evolution versus puff count in accordance with various filter configurations. As shown in FIGS. 5-10 and 12-13, the higher volatile organic compound (VOC) deliveries, especially in the early puffs, and the flatter profile for the cellulose acetate (CA)/carbon on tow (COT) 105 mg custom filter, with 4 holes suggests that carbon bypass is taking place and that the initial carbon bypass may contribute to an improved removal efficiency at the late puffs. FIGS. 9 and 10 show that a filter with a 105 mg carbon on tow (COT) design with a bypass tube has similar deliveries for acetaldehyde in the first puffs as the 60 mg COT control (no tube). The deliveries, however, diverged as puff count increased.

Figure 5:
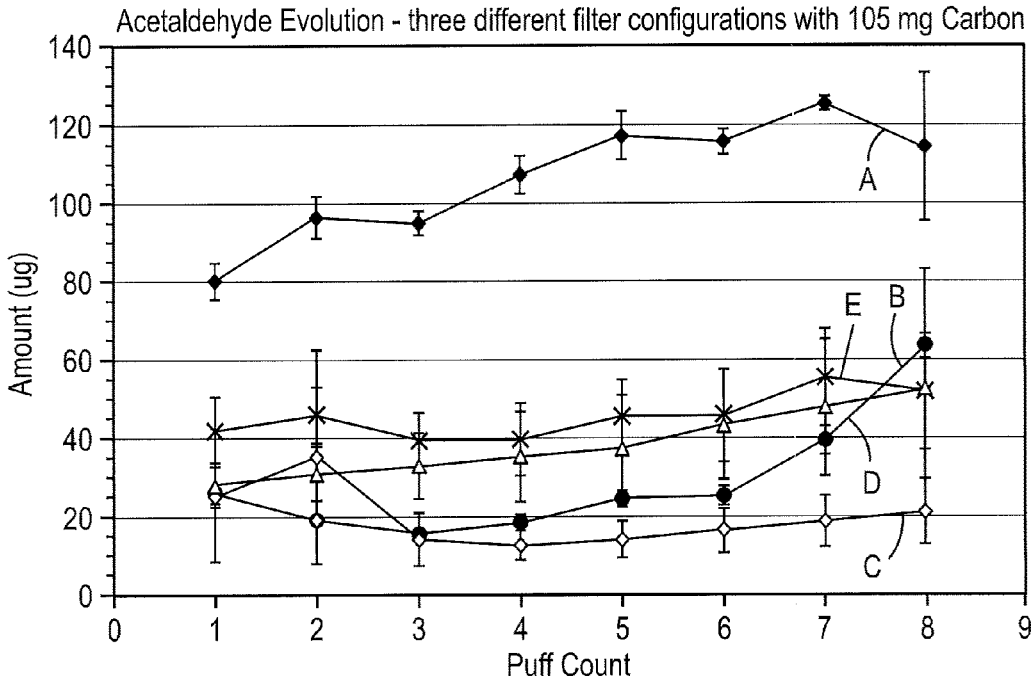
FIG. 5 is a graph of acetaldehyde evolution versus puff count in accordance with one embodiment for three different filter configurations with a 105 mg carbon filter.
Figure 6:
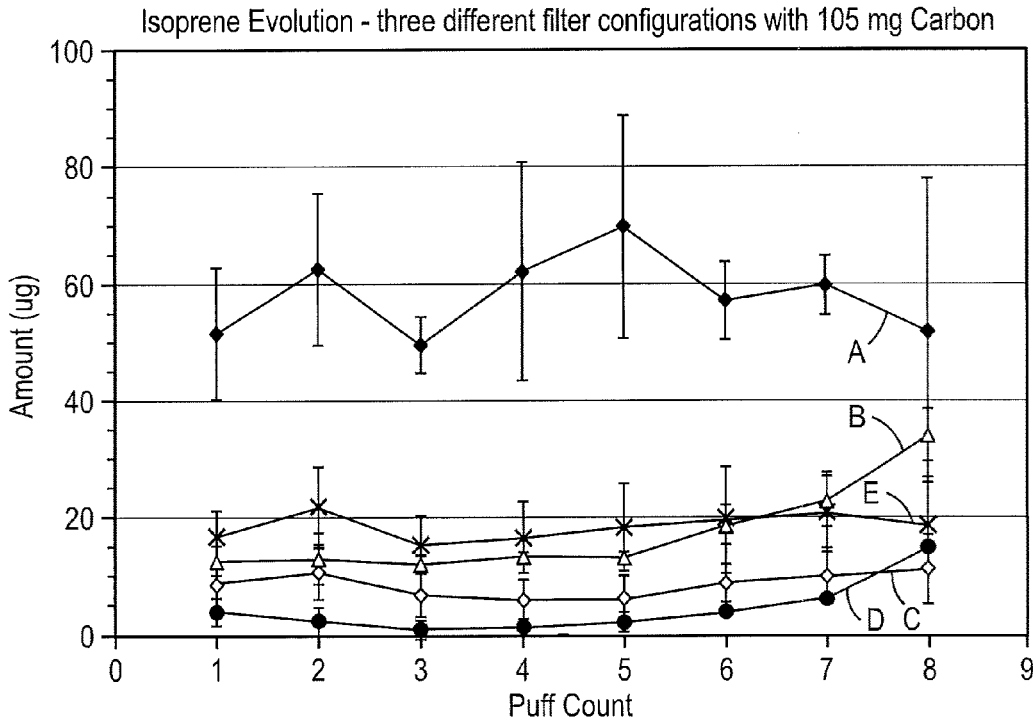
FIG. 6 is a graph of isoprene evolution versus puff count in accordance with another embodiment for two different filter configurations with a 105 mg carbon filter.

FIGS. 5 and 6 show acetaldehyde evolution and isoprene evolution versus puff count for three different filter configurations with a 105 mg (milligram) carbon on tow filter. As shown in FIGS. 5 and 6, curve A is a commercially available tobacco rod (ultra low delivery) with a cellulose acetate (CA) filter; curve B is commercially available tobacco rod (ultra low delivery) with a 105 mg carbon on tow filter segment with multiple holes and a cellulose acetate (CA) mouthpiece; curve C is a commercially available tobacco rod with a 110 mg carbon on tow filter segment (unplugged tube) and a cellulose acetate (CA) mouthpiece; curve D is a commercially available tobacco rod (ultra low delivery) with a 105 mg carbon on tow filter segment and a cellulose acetate (CA) mouthpiece; and curve E is a commercially available tobacco rod (ultra low delivery) with a 105 mg carbon on tow filter segment with 4 holes and a cellulose acetate (CA) mouthpiece.

Figure 7:
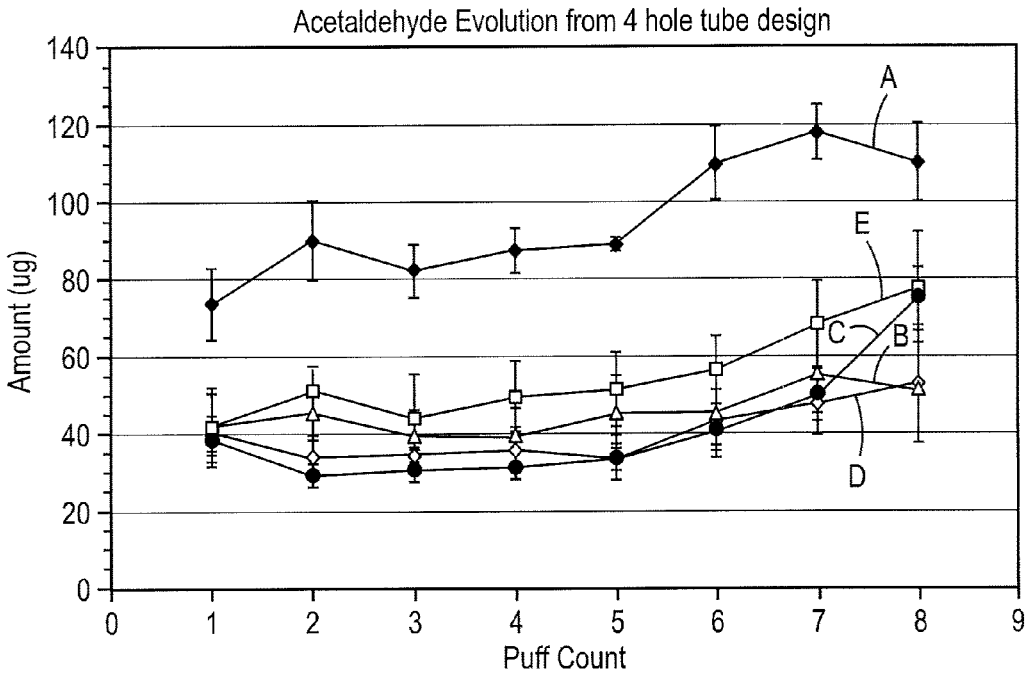
FIG. 7 is a graph of acetaldehyde evolution versus puff count for a smoking article as shown in FIG. 1

FIGS. 7 and 8 show acetaldehyde evolution and isoprene evolution versus puff count from a 4 (four) hole tubular design for several commercially available cigarette configurations. As shown in FIGS. 7 and 8, curve A is a commercially available tobacco rod (ultra low delivery) rod with a cellulose acetate (CA) filter; curve B is commercially available tobacco rod (ultra low delivery) with a 105 mg carbon on tow segment with multi-holes and a cellulose acetate (CA) mouthpiece; curve C is a commercially available tobacco rod (ultra low delivery) with a 60 mg carbon on tow segment with a bypass and a cellulose acetate (CA) mouthpiece; curve D is a commercially available tobacco rod (ultra low delivery) with a 105 mg carbon on tow segment and a cellulose acetate (CA) mouthpiece; and curve E is a commercially available tobacco rod (ultra low delivery) rod with a 60 mg carbon on tow segment and a cellulose acetate (CA) mouthpiece.

FIGS. 9 and 10 show acetaldehyde evolution and isoprene evolution versus puff count from experimental cigarettes on a puff by puff basis. As shown in FIGS. 9 and 10, curve A is a commercially available tobacco rod (ultra low delivery) rod with a 105 mg carbon on tow segment with bypass and a cellulose acetate (CA) mouthpiece; and curve B is a commercially available tobacco rod (ultra low delivery) with a 60 mg carbon on tow segment and a cellulose acetate (CA) mouthpiece.

Figure 11:
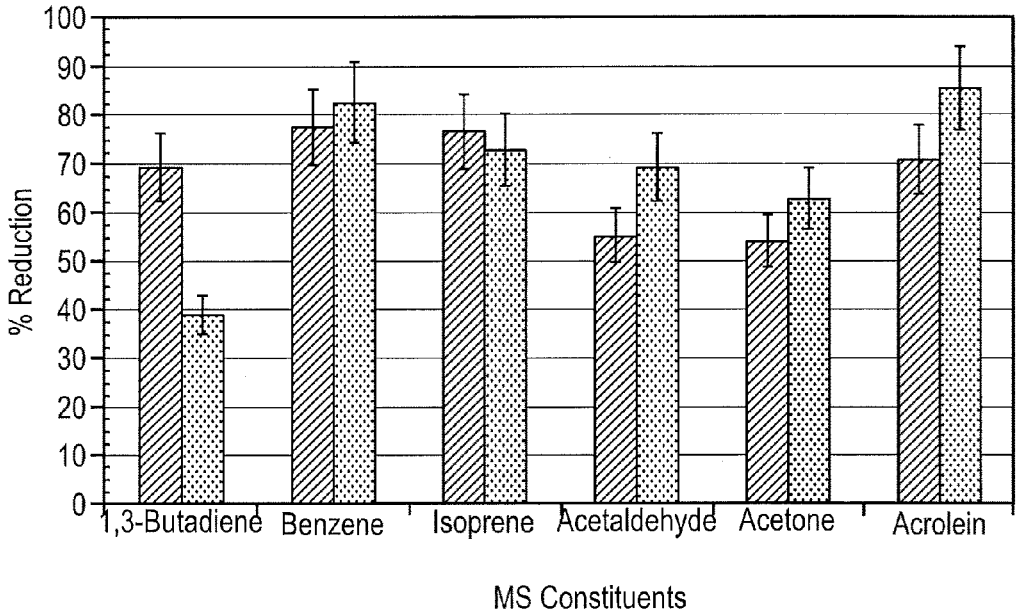
FIG. 11 is a graph comparing percent of mainstream smoke (MS) constituent reductions of a filter design in accordance with one embodiment to a commercially available cigarette.

FIG. 11 is a graph comparing percent of mainstream smoke (MS) constituent reductions of a filter design in accordance with one embodiment to another commercially available cigarette. As shown in FIG. 11, the bars on the left is a commercially available cigarette with a 105 mg carbon on tow segment with bypass, and the bars on the right are a commercially available cigarette with a restriction and a 60 mg carbon on tow segment.

Figure 12:
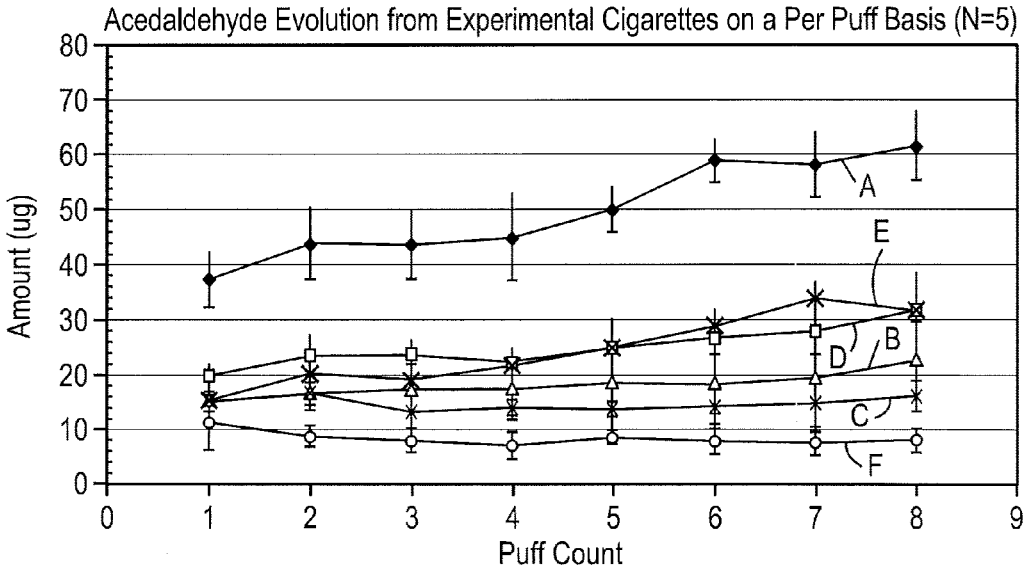
FIG. 12 is a graph of acetaldehyde evolution versus puff count for a smoking article as shown in FIG. 3.
Figure 13:
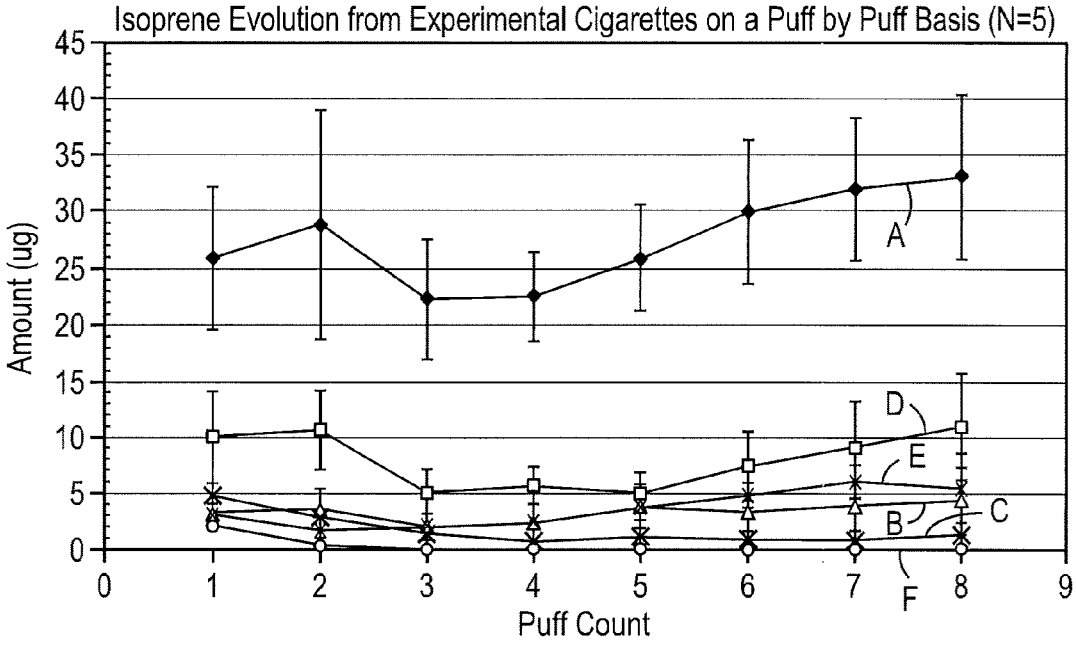
FIG. 13 is a graph of isoprene evolution versus puff count for a smoking article as shown in FIG. 3.

FIGS. 12 and 13 show acetaldehyde evolution and isoprene evolution versus puff count from experimental cigarettes on a puff by puff basis. As shown in FIGS. 12 and 13, curve A is a commercially available tobacco rod (ultra low delivery) with a cellulose acetate (CA) mouthpiece; curve B is commercially available tobacco rod (ultra low delivery) rod with a 22 mm carbon on tow segment and a 22 mm bypass tube (10 holes), and a cellulose acetate (CA) mouthpiece; curve C is commercially available tobacco rod (ultra low delivery) with a 26 mm Carbon on tow and a 26 mm bypass tube (10 holes), and a cellulose acetate (CA) mouthpiece; curve D is commercially available tobacco rod (ultra low delivery) with a 22 mm carbon on tow and a 25 mm bypass tube (10 holes), and a cellulose acetate (CA) mouthpiece; curve E is commercially available tobacco rod (ultra low delivery) rod with a 12 mm carbon on tow (i.e., 60 mg carbon on tow) and a cellulose acetate (CA) mouthpiece; and curve F is a commercially available tobacco rod (ultra low delivery) with a 26 mm carbon on tow without a bypass tube, and a cellulose acetate (CA) mouthpiece.

Table 1 shows total particulate material (TPM) delivery for a plurality of smoking articles. As shown in Table 1, the TPM delivered in the 105 mg carbon on tow (COT) filter was typical of a commercially available cigarette with full flavor because there was no dilution. The 50 mg COT cigarettes were commercially available cigarettes with 12 dilution holes around the circumference of the filter.

TABLE 1

Total Particulate Matter (TPM) Delivery from Experimental Filters

| Filter Configuration | Mean Tar Delivery (mg) | Standard Deviation (mg) |
|---|---|---|
| CA/CA Control | 15.6 | 1.9 |
| CA/60 mg COT 4 hole tube | 12.9 | 1.6 |
| CA/110 mg COT 4 hole tube | 12.3 | 1.9 |
| CA/110 mg COT multi hole tube | 14.5 | 2.2 |
| CA/110 mg COT open ended tube | 14.8 | 2.1 |
| CA/60 mg COT no tube | 10.2 | N/A |
| CA/110 mg COT no tube | 10.7 | 1.9 |

Table 2 shows acetaldehyde and isoprene delivery with respect to a number of commercially available cigarettes and smoking articles in accordance with one embodiment. As shown in Table 2, there was a significant decrease in both acetaldehyde and isoprene deliveries. For example, the values for acetaldehyde fall within the range for a commercially available cigarette while delivering the total particulate matter (TPM) of a full flavor smoking article, and the isoprene dropped well below the value currently seen on the commercially available cigarette configuration.

TABLE 2

Acetaldehyde and Isoprene Delivery with Respect to Commercially Available Products

| Cigarette Type | Acetaldehyde (μg/cig) | SD in Acetaldehyde (μg/cig) | Isoprene (μg/cig) | SD in Isoprene (μg/cig) |
|---|---|---|---|---|
| Full Flavor | 742.17 | 60.01 | 442.69 | 23.5 |
| Low Delivery | 684.92 | 51.82 | 409.50 | 28.63 |
| Ultra Low Delivery | 406.17 | 42.94 | 265.79 | 10.89 |
| CA/60 mg COT 4 holes | 479 | 48 | 203 | 28 |
| CA/110 mg COT 4 holes | 376 | 48 | 151 | 37 |
| CA/110 mg COT multi-hole | 473 | 93 | 154 | 32 |

It will be understood that the foregoing description is of the preferred embodiments, and is, therefore, merely representative of the article and methods of manufacturing the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A filter for a smoking article comprising:

an upstream segment comprising:

a carbon filter; and a hollow tubular member concentrically positioned within the carbon filter and having one or more holes around an outer circumference of the hollow tubular member to allow mainstream smoke to bypass the carbon filter during the first puffs, and wherein after the initial puff or puffs, mainstream smoke is drawn through the carbon filter;

a downstream segment of filtering material; and a cavity between the upstream segment and the downstream segment, the hollow tubular member extending into the cavity.

2. The filter of claim 1, wherein the hollow tubular member extends from an upstream end of the filter to a downstream end of the cavity.

3. The filter of claim 1, wherein the one or more holes is comprised of at least one row of holes around the outer circumference of the hollow tubular member, which are partially or totally blocked following the initial puff or puffs.

4. The filter of claim 1, comprising an impermeable plug on a downstream end of the hollow tubular member.

5. The filter of claim 1, wherein the carbon filter includes an activated carbon material and a cellulose acetate material.

6. The filter of claim 1, wherein the filtering material of the downstream segment is cellulose acetate.

7. The filter of claim 1, wherein the one or more holes comprise at least two circumferential rows of at least two holes, and wherein the at least two circumferential rows of at least two holes extend from an upstream end to a downstream end of the tubular member.

8. The filter of claim 1, wherein the carbon filter includes a carbonaceous material.

9. The filter of claim 1, wherein the carbon filter further includes a filter adsorbent and/or a catalyst material.

10. A filter for a smoking article comprising:

an upstream segment comprising:

a carbon filter; and a hollow tubular member concentrically positioned within the carbon filter and having one or more holes around an outer circumference of the hollow tubular member to allow mainstream smoke to bypass the carbon filter during the first puffs, and wherein after the initial puff or puffs, mainstream smoke is drawn through the carbon filter;

a downstream segment of filtering material wherein the one or more holes are located in a cavity between the upstream segment and the downstream segment.

11. A filter for a smoking article comprising:

an upstream segment comprising:

a carbon filter; and a hollow tubular member concentrically positioned within the carbon filter and having one or more holes around an outer circumference of the hollow tubular member to allow mainstream smoke to bypass the carbon filter during the first puffs, and wherein after the initial puff or puffs, mainstream smoke is drawn through the carbon filter;

a downstream segment of filtering material; and an impermeable plug on a downstream end of the hollow tubular member wherein the impermeable plug located on the downstream end of the hollow tubular member is located within a cavity located between the upstream segment and the downstream segment, and wherein the impermeable plug has an opening therein.

12. A smoking article comprising:

a rod of smokable material; and a filter attached to the tobacco rod of smokable material, the filter comprising:

an upstream segment of an activated carbon material, wherein the upstream segment includes a hollow tubular member concentrically positioned within the activated carbon material, wherein the hollow tubular member has one or more holes around an outer circumference of the hollow tubular member to allow mainstream smoke to bypass the carbon filter during the first puffs;

a downstream segment of filtering material;

a cavity located between the upstream segment and the downstream segment, the tubular member extending into the cavity; and wherein after the initial puff or puffs the mainstream smoke is drawn through the activated carbon material.

13. The smoking article of claim 12, wherein the one or more holes is comprised of at least one row of holes around the circumference of the hollow tubular member, which are partially or totally blocked following the initial puff or puffs on the smoking article.

14. The smoking article of claim 12, wherein the hollow tubular member extends from an upstream end of the filter to a downstream end of the upstream segment and further includes an impermeable plug on the downstream end of the hollow tubular member.

15. The smoking article of claim 14, wherein the impermeable plug located on the downstream end of the hollow tubular member has an opening therein.

16. The smoking article of claim 12, wherein the one or more holes comprises at least two rows of holes around the circumference of the hollow tubular member.

17. The smoking article of claim 12, wherein the one or more holes are located in the cavity between the upstream segment and the downstream segment.

18. The smoking article of claim 12, wherein the one or more holes comprise at least two circumferential rows of at least two holes, and wherein the at least two circumferential rows of at least two holes extend from an upstream end to a downstream end of the tubular member.

19. The smoking article of claim 12, wherein the activated carbon material is a carbon material and a cellulose acetate material.

20. The smoking article of claim 12, wherein the rod of smokable material is a tobacco rod.

* * * * *